United States Patent [19]

Wahle et al.

[11] Patent Number: 4,580,579

[45] Date of Patent: Apr. 8, 1986

[54] METHOD AND APPARATUS FOR PRODUCING A COMPOSITE TOBACCO FILLER

[75] Inventors: Günter Wahle, Reinbek; Wolfgang Steiniger, Börnsen, both of Fed. Rep. of Germany

[73] Assignee: Hauni-Werke Körber & Co. KG, Hamburg, Fed. Rep. of Germany

[21] Appl. No.: 572,564

[22] Filed: Jan. 18, 1984

[30] Foreign Application Priority Data

Jan. 26, 1983 [DE] Fed. Rep. of Germany ..... 3302476

[51] Int. Cl.[4] ..... A24C 5/18; A24C 5/20

[52] U.S. Cl. ..... 131/84.3; 131/84.1; 131/84.4

[58] Field of Search ..... 131/84 B, 84 C, 84 A, 131/84.1, 84.2, 84.3, 84.4

[56] References Cited

U.S. PATENT DOCUMENTS

| | | | |
|---|---|---|---|
| 1,721,117 | 7/1929 | Hopkins | 131/84 B |
| 3,736,941 | 6/1973 | Molins et al. | 131/84 B |
| 3,871,385 | 3/1975 | David | 131/84 B |
| 3,987,804 | 10/1976 | Molins et al. | 131/84 B |
| 4,175,570 | 11/1979 | Heitmann | 131/84 B |
| 4,185,644 | 1/1980 | Heitmann et al. | 131/84 B |
| 4,280,516 | 7/1981 | Reuland | 131/84 C |
| 4,284,087 | 8/1981 | Reuland | 131/84 B |
| 4,290,436 | 9/1981 | Reuland | 131/84 B |
| 4,459,998 | 7/1984 | Labbe et al. | 131/364 |

*Primary Examiner*—V. Millin

*Attorney, Agent, or Firm*—Peter K. Kontler

[57] ABSTRACT

A composite tobacco filler is formed in three stages by showering or otherwise depositing the particles of a first tobacco type at one side of a first air-permeable suction conveyor to form a narrow core one surface of which contacts the first conveyor; by thereupon depositing on the first conveyor a first layer which consists of another type of tobacco, which overlies the core, and whose marginal portions extend laterally beyond the core; by thereupon transferring the core and the first layer onto a second air-permeable suction conveyor so that the one surface of the core becomes exposed and the first layer directly contacts one side of the second conveyor; and by thereafter showering a second tobacco layer of the other type onto the exposed surface of the core and onto the marginal portions of the first layer to thus complete the formation of a filler wherein the core is completely surrounded by the material of the two layers. The core can be trimmed prior to formation of the first layer, the first layer can be trimmed prior to transfer onto the second conveyor, and the second layer can be trimmed on the second conveyor.

36 Claims, 11 Drawing Figures

IA
201
202
203
204
206
207a
207b
208a
208b
209
211
212
213
214
214a
216
217
221
222
223
224
226
227
228
K
T
TL1
TL2
VIII
IX
X
XI

METHOD AND APPARATUS FOR PRODUCING A COMPOSITE TOBACCO FILLER

BACKGROUND OF THE INVENTION

The present invention relates to a method and apparatus for the production of a continuous rod-like filler which consists of or contains particles of tobacco. Such fillers are draped into webs of cigarette paper or the like in cigarette rod making machines for the production of continuous rods which are thereupon subdivided into sections (e.g., plain cigarettes or cigarillos) of desired length. More particularly, the invention relates to improvements in a method and apparatus for the production of a filler which contains several types or blends of tobacco. Still more particularly, the invention relates to a method and apparatus for the production of a rod-like filler wherein a core of a first type of tobacco (which may be a natural, artificial (substitute) or reconstituted tobacco) is surrounded by an annular or tubular envelope or shell containing or consisting of particles of another type of tobacco.

U.S. Pat. No. 3,987,804 discloses several embodiments of a method of and several embodiments of an apparatus for the production of a tobacco filler having a core consisting of a first type or blend of tobacco and a tubular envelope which surrounds the core and contains a different second type or blend of tobacco. All disclosed embodiments of the method and apparatus share the feature that a first layer of particulate material which is to constitute the envlope is showered onto a suction-operated belt conveyor, that a relatively narrow stream of particulate material which is to constitute the core is showered onto the first layer, and that a second layer of particulate material which is to constitute the envolpe is showered over the stream and over the exposed marginal portions of the first layer. The just discussed method and apparatus exhibit the drawback that the position of the stream on the first layer is not fixed, i.e., such position cannot be determined and maintained with a requisite degree of accuracy. Attempts to ensure that the stream will be formed exactly midway or substantially midway between the marginal portions of the first layer include imparting to the exposed surface of the first layer a concave shape so that such layer resembles an elongated trough and is more likely to center the stream midway between the marginal portions. This greatly increases the initial and maintenance cost of the apparatus and renders the apparatus prone to malfunction because the formation of a first layer with a concave upper side or exposed side involves a corresponding deformation and guidance of the conveyor on which the first layer is formed.

The aforementioned patent further refers to the possibility of forming a relatively thin first layer on the suction-operated conveyor, thereupon narrowing the tobacco channel above the first layer and showering the material of the stream into such narrow portion of the channel, and finally showering particles of tobacco into a wider portion of the channel to form the second layer on top of the narrow stream and the marginal portions of the first layer. The utilization of a channel which has a wide portion for reception of the material of the first layer, which thereupon narrows to receive the material of the stream, and which widens again to receive the material of the second layer is not likely to contribute to operativeness of the apparatus because the narrow portion of the tobacco channel downstream of a wider portion invites the development of so-called stoppers, i.e., clogging of the tobacco channel with attendant lengthy interruptions of operation of the machine in which the apparatus is put to use.

On the other hand, the making of a tobacco filler from several blends of tobacco is often desirable and advantageous, for example, to conceal tobacco whose color or another characteristic is less desirable, to confine so-called short, discard or excess tobacco within the longer shreds of the envelope, to allow for more accurate approximation of the weight of plain cigarettes to the desired or optimum weight and/or for other reasons.

OBJECTS AND SUMMARY OF THE INVENTION

An object of the invention is to provide a novel and improved method of producing a tobacco filler wherein a core of first particulate material (such as natural, substitute and/or reconstituted tobacco) is surrounded by an annular or tubular envelope consisting of or containing a second type of particulate material and which can be practiced without risking so-called stoppers in the apparatus which is used for the practice of the method.

Another object of the invention is to provide a method which can be practiced in such a way that the material of the core is not visible in the ultimate products.

A further object of the invention is to provide a method which renders it possible to produce a composite filler at the rate that is necessary in a modern high-speed cigarette making machine for the production of up to and even well in excess of 8000 rod-shaped articles per minute.

Still another object of the invention is to provide a method which can be resorted to for adequately confining relatively short or small particles of tobacco within a tubular body which consists of or contains a high percentage of long tobacco shreds.

An additional object of the invention is to provide a novel and improved apparatus for the practice of the above outlined method and to construct and assemble the apparatus in such a way that it can turn out a continuous rod-like tobacco filler with a surprisingly high degree of reproducibility and can ensure that the core is located at least substantially at the center of the filler even though the apparatus need not employ any means for flexing one or more endless belt conveyors about one or more longitudinally extending axes.

Still another object of the invention is to provide the apparatus with novel and improved means for building the constituents of the filler in several successive stages.

A further object of the invention is to provide an apparatus which can be incorporated in existing cigarette rod making or analogous machines as a superior substitute for heretofore known filler making apparatus.

One feature of the invention resides in the provision of a method of producing a rod-like tobacco filler wherein a core containing a first particulate material (e.g., a first blend of shredded tobacco) is surrounded by an annular envelope containing a different second particulate material (e.g., a second blend of shredded tobacco). The method comprises the steps of building on an air-permeable first conveyor (e.g., an endless belt conveyor or a rotary wheel-shaped conveyor) a stream of first material having a first width, pneumatically holding the stream on the first conveyor so that one side of the stream abuts against the conveyor, utilizing the conveyor to advance the stream lengthwise, depositing on the conveyor a first elongated layer containing particles of second material and having a greater second width so that a central portion of the layer overlies the stream and two marginal portions of the layer extend laterally beyond the stream, transferring the first layer and the stream onto a second conveyor so that the one side of the stream becomes exposed, utilizing the second conveyor to advance the stream and the first layer lengthwise, and depositing on the one side of the stream as well as on the marginal portions of the first layer a second layer containing particles of the second material. The building step may comprise showering particles of first material onto the first conveyor. Furthermore, the building step can comprise depositing on the first conveyor particulate material in excess of that which is required in the stream, and the method then preferably further comprises the step of removing the excess from the stream prior to deposition of the first layer on the first conveyor. If desired, the aforementioned showering step can be replaced with the step of depositing on the first conveyor a file of discrete stream sections of finite length.

The step of depositing the first layer can include depositing particles of second material first at one side of the stream to form one of the marginal portions, thereupon at the other side of the stream to form the other marginal portion, and thereafter over the stream to form the central portion of the first layer. The step of depositing the first layer can further include delivering onto the first conveyor second material in excess of that which is required in the first layer, and the method then further comprises the step of removing the excess prior to the transferring step.

The step of depositing the second layer can also include delivering onto the second conveyor second material in excess of that which is required in the second layer, and the method then preferably further comprises the step of removing the excess of second material from the second conveyor.

Still further, the method can comprise the steps of draping the filler (including the stream and the two layers) into a web of wrapping material (such as cigarette paper), monitoring at least one characteristic (preferably density) of the draped filler, and regulating the one and/or the other excess removing step when the monitored characteristic of the draped filler deviates from a preselected value.

Another feature of the invention resides in the provision of an apparatus for producing a rod-like tobacco filler wherein a core containing a first particulate material (e.g., a first blend of shredded or otherwise comminuted natural, substitute and/or reconstituted tobacco) is surrounded by an annular envelope containing a different second particulate material (e.g., a second blend of shredded or otherwise comminuted natural, substitute or reconstituted tobacco). The apparatus comprises an air-permeable first conveyor (e.g., an endless belt conveyor) having a first and a second side and a predetermined effective width, a suction chamber or other suitable means for establishing between the first and second sides of the conveyor a pressure differential so that the pressure at one of the sides exceeds the pressure at the other side, a first distributor or another suitable material supplying device which serves to deposit on the one side of the first conveyor and substantially centrally of such one side an elongated stream which contains particles of first material, which has a second width less than the predetermined width so that two marginal portions of the one side of the first conveyor remain exposed, and which has a surface in direct contact with the one side of the first conveyor, a second material supplying device which serves to deposit on the stream and on the marginal portions of the one side of the first conveyor a first layer containing particles of second material and having marginal portions directly overlying the marginal portions of the one side of the first conveyor, a second conveyor (e.g., an air-permeable endless belt conveyor) which is arranged to receive the stream and the first layer so that the first layer directly overlies the second conveyor and the aforementioned surface of the stream becomes exposed, and a third material supplying device which serves to deposit on the surface of the transferred stream and on the marginal portions of the transferred first layer a second layer containing second particulate material so that the stream is fully confined between the first and second layers of the resulting filler.

The apparatus preferably further comprises a pair of sidewalls which flank the first conveyor and extend beyond the one side of the latter. The second conveyor can constitute an air-permeable endless belt conveyor having first and second sides and the apparatus can further comprise two additional sidewalls extending beyond the first side of the second conveyor and a suction chamber adjacent to the second side of the second conveyor so that the transferred first layer is attracted to the first side of the second conveyor. The sidewalls of the aforementioned pair and the first conveyor define a first elongated tobacco channel preferably having a substantially rectangular cross-sectional outline, and the additional sidewalls define with the second conveyor a second elongated channel having a preferably rectangular or substantially rectangular cross-sectional outline. The first and second material supplying devices deliver particulate material into the first channel, and the third material supplying device delivers particulate material into the second channel.

As mentioned above, the first conveyor can constitute an endless air-permeable belt conveyor. Alternatively, the first conveyor can constitute or include a rotary wheel-shaped conveyor.

The first channel can include a narrower first portion which receives particulate material from the first material supplying device and a wider second portion which receives particulate material from the second material supplying device. The first material supplying device can include means for showering particulate material into the first portion of the first channel. The first material supplying device further comprises a source of first particulate material and the showering means can comprise a guide which directs particles of first material from the source into the central region of the first portion of the first channel as well as a nozzle which discharges one or more jets of compressed air or other suitable means for propelling particles of first material along the guide. The first material supplying device can be arranged to deliver material in excess of that which is required in the stream, and the apparatus then preferably further comprises an equalizing device which is adjacent to the one side of the first conveyor ahead of the second material supplying device (as considered in the direction of advancement of the stream with the first conveyor) and serves to remove the excess from the stream on the first conveyor.

Instead of showering particles of first material onto the one side of the first conveyor, the first material supplying device can comprise means for delivering to the one side of the first conveyor a file of discrete elongated sections of the stream so that successive sections of the file are separated from one another. The means for delivering sections of the stream can comprise a rotary conveyor having a peripheral surface provided with an annulus of elongated circumferentially extending pockets each of which can accumulate a discrete section of the stream and can deliver such section to the one side of the first conveyor. The rotary conveyor can be provided with a foraminous bottom wall which is inwardly adjacent to the pockets and a suction chamber which is adjacent to the bottom wall opposite the pockets to draw particulate material into the pockets and to attract the thus drawn particulate material during delivery of sections to the one side of the first conveyor. The apparatus including such rotary conveyor preferably further comprises means for driving the rotary conveyor in synchronism with the first conveyor so that the speed of the sections matches the speed of the first conveyor at least during transfer from the pockets onto the one side of the first conveyor. This first material supplying device can comprise means for showering particles of first material into the pockets of the rotary conveyor and such showering means can be arranged to shower first material in excess of that which is required in the sections of the stream. The apparatus then preferably further comprises equalizing means which is adjacent to the rotary conveyor and serves to remove the excess of particulate material from successive pockets. The equalizing means can comprise entraining elements (e.g., the bristles of one or more rotary brushes) arranged to rotate about a predetermined axis which is preferably normal or nearly normal to the axis of rotation of the rotary conveyor.

The second material supplying device can include guide means which serves to direct particles of second material against the marginal portions of the one side of the first conveyor in the first channel, a source of second material, and means (e.g., one or mcre nozzles which discharge jets of compressed air) for propelling particles of second material from the source, along the guide means and against the marginal portions of the one side of the first conveyor at the opposite sides of the stream. In accordance with a presently preferred embodiment of the invention, the just mentioned guide means includes a first section which serves to direct particles of second material first against one marginal portion of the one side of the first conveyor, a second section which thereupon directs particles of second material against the other marginal portion of the one side of the first conveyor, and a third section which thereafter directs particles of second material against the exposed side of the stream or across the full width of the first conveyor.

The second and/or the third material supplying device can also deliver particulate material in excess of that which is required in the first and/or second layer, and the apparatus then further comprises a first and/or a second equalizing device which is arranged to remove the excess from the first and/or second layer. The first equalizing device is adjacent to the first conveyor and the second equalizing device is adjacent to the second conveyor. The first and/or the second equalizing device is or can be adjustable. This is desirable if the apparatus further comprises a source (e.g., a reel) of wrapping material (such as cigarette paper), means for draping the filler (including the stream and the two trimmed layers) into the wrapping material and means for monitoring at least one characteristic of the wrapped filler (preferably the density of the filler). Such apparatus preferably further comprises means for adjusting the first and/or second equalizing device when the monitored density and/or another characteristic of the wrapped filler deviates from a predetermined value (e.g., when the density deviates from a predetermined range of acceptable densities).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
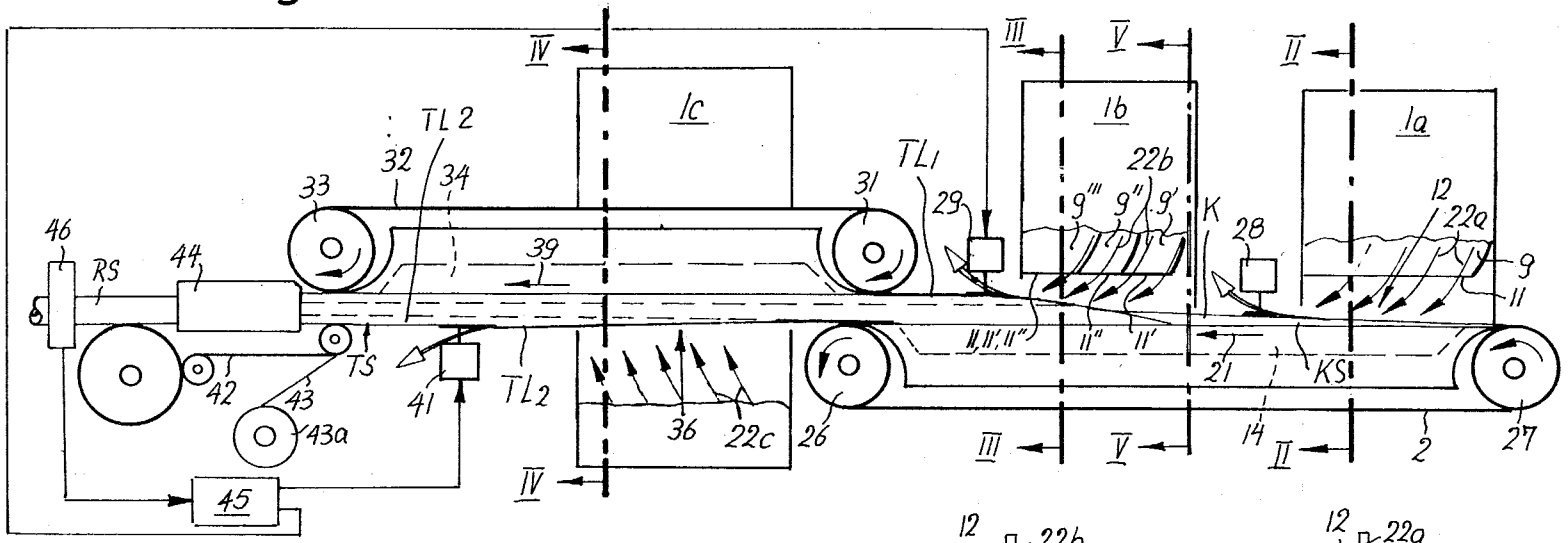
FIG. 1 is a schematic side elevational view of an apparatus which embodies one form of the invention, with portions of the material supplying devices broken away and further showing that portion of a cigarette rod making machine which receives the finished filler for wrapping into a web of cigarette paper.
Figure 2:
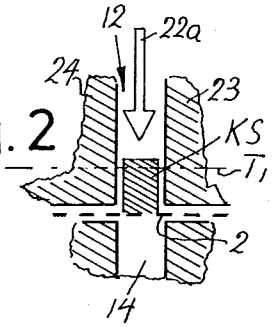
FIG. 2 is an enlarged fragmentary transverse vertical sectional view of the first material supplying device as seen in the direction of arrows from the line II—II of FIG. 1.
Figure 3:
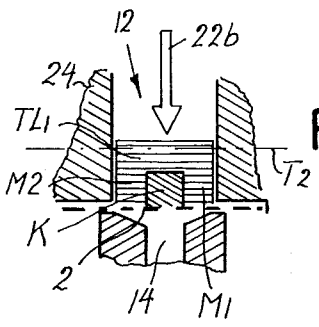
FIG. 3 is a similar enlarged fragmentary transverse vertical sectional view of the second material supplying device as seen in the direction of arrows from the line III—III of FIG. 1.
Figure 4:
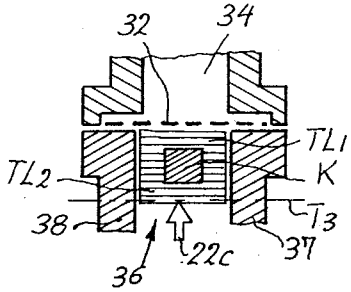
FIG. 4 is a similar enlarged fragmentary transverse vertical sectional view of the third material supplying device as seen in the direction of arrows from the line IV—IV of FIG. 1.

Referring first to FIGS. 1 to 5, there is shown an apparatus which is incorporated into a cigarette rod making machine and serves to produce a continuous composite rod-like filler TS which can be seen in FIGS. 1 and 4 and comprises an elongated core K consisting of a first particulate material (e.g., light-colored tobacco shreds or fragments of shreds) and an elongated tubular envelope including a first layer TL1 and a second layer TL2 both consisting of a second particulate material (e.g., tobacco shreds having a color which is darker than that of the particles forming the core K). The layer TL1 surrounds three sides or surfaces of the core K which has a rectangular or square cross-sectional outline, and the layer TL2 is immediately adjacent to the remaining (lower) side or surface of the core K and has two longitudinally extending marginal portions contacting the respective longitudinally extending marginal portions M1 and M2 of the layer TL1. The filler TS has a rectangular or square cross-sectional outline, and the core K is located centrally or nearly centrally of the tubular envelope including the layers TL1 and TL2.

The apparatus of FIGS. 1 to 5 comprises three material supplying devices 1*a*, 1*b*, 1*c* each of which is a distributor (called "hopper" in certain English-speaking countries), e.g., of the type disclosed in commonly owned U.S. Pat. No. 4,185,644. The device 1*a* delivers particulate material of the first type, i.e., the particles which form the core K, the device 1*b* delivers particulate material of the second type (such material forms the first layer TL1), and the device 1*c* supplies material of the second type for the making of layer TL2. The devices 1*a* and 1*b* are arranged to shower particles of tobacco onto the substantially horizontal upper reach of an air-permeable endless belt conveyor 2 which is trained over pulleys 26, 27 (at least one of which is driven) so that its upper reach extends below the lower end portions of the devices 1*a* and 1*b*. Since the devices 1*a* and 1*b* are designed to supply particulate material from above, their construction deviates somewhat from that of the distributor which is described and shown in the aforementioned U.S. Pat. No. 4,185,644. The differences will be readily appreciated by looking at FIG. 5 which shows, by way of example, a presently preferred construction of the material supplying device 1*b*. Particles T of tobacco are supplied by a source including an endless belt conveyor 3 whose upper reach receives such particles from the carding of a carded drum (not shown) with assistance from a picker roller (not shown) so that the upper reach of the conveyor 3 gathers and advances a continuous wide carpet of particles T. Such particles are advanced toward and are propelled beyond a pulley 4 for the conveyor 3 and against a curtain CT consisting of parallel jets of compressed air which issue from the nozzle 6 of a tobacco classifying device 5. The inertia of heavier particles T (e.g., fragments of ribs, birds' eyes and the like) suffices to enable such particles to traverse the curtain CT and to enter an intercepting container 8. The other particles T (primarily shreds and the like) are deflected by the curtain CT and descend against the concave surface of a stationary guide 7 which is mounted in the frame of the cigarette rod making machine and directs the lighter particles T into the range of a pneumatic conveyor 16 including a horizontal or nearly horizontal nozzle 18 which receives compressed air from a plenum chamber 19. The latter is connected with the pressure side of a suitable air compressor (not shown) by a conduit 17.

The distributor which is described and shown in U.S. Pat. No. 4,185,644 includes the parts 3 to 7 but not the pneumatic conveyor 16 or a second guide 9 which has a concave underside and serves to direct lightweight particles T of tobacco of the first type into a tobacco channel 12 at a level above the upper reach of the conveyor 2. The concave underside of the second guide 9 defines for particles T an arcuate path which is an extension of the arcuate path defined by the upper side of the first guide 7, and the pneumatic conveyor 16 constitutes a means for propelling particles T along the concave underside of the guide 9 toward and into the channel 12. The channel 12 has an air-permeable bottom wall 13 which is the top wall of a suction chamber 14 at the underside of the upper reach of the conveyor 2. The chamber 14 establishes a pressure differential between the upper side and the underside of the upper reach of the conveyor 2 so that the pressure at the upper side exceeds the pressure at the lower side and the upper reach of the conveyor 2 can attract and retain the particles T which travel along the underside of the guide 9 and thereupon enter the channel 12. The manner in which the suction chamber 14 is connected to the intake of a suction generating device is not specifically shown in the drawing. Reference may be had to the commonly owned copending patent application U.S. Ser. No. 557,735 filed Dec. 2, 1983 by Günter Wahle et al. for "Method and apparatus for building a tobacco stream". The width of that portion of the channel 12 into which the guide 9 directs particles T of tobacco toward the upper side of the upper reach of the conveyor 2 exceeds the width of the preceding portion of the channel 12, namely of the portion which receives tobacco particles from the guide 9 (see the right-hand portion of FIG. 1) of the first tobacco supplying device 1*a*. The nozzle 18 of FIG. 5 has suitably inclined guide walls or vanes 18*a* extending into the interior of the plenum chamber 19, and the purpose of such vanes is to impart to the jet or jets of air issuing from the orifice or orifices of the nozzle 18 a component of movement in the direction (note the arrow 21 in FIG. 1) of forward movement of the upper reach of the conveyor 2. This ensures that the particles T which enter the channel 12 at a level below the device 1*b* have a component of movement (arrow 22*b* in FIGS. 1 and 3) in the direction of travel of the growing first tobacco layer TL1 with the upper reach of the conveyor 2. The construction of the material supplying device 1*a* is practically identical with that of the device 1*b* except that the device 1*a* contains a source of particles of the first type and that the corresponding guide 9 is simpler than the guide 9 in the device 1*b*. The direction in which the particles of the first type advance along the respective guide 9 and into the corresponding portion of the channel 12 is indicated by the arrows 22*a* (see FIGS. 1 and 2).

Figure 5:
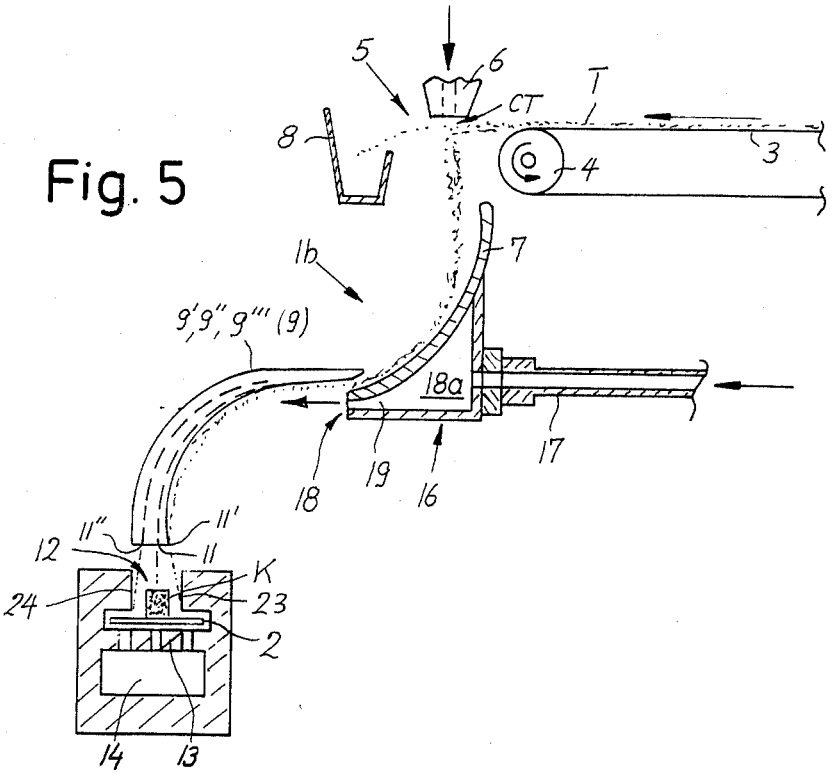
FIG. 5 is an enlarged transverse vertical sectional view of the second material supplying device as seen in the direction of arrows from the line V—V of FIG. 1.

The material supplying device 1*b* of FIG. 5 (and the corresponding device 1*a*) can be replaced with distributors of the type disclosed in commonly owned U.S. Pat. No. 3,871,385. The distributor of this patent comprises guide means corresponding to the guides 9 (reference may be had to FIGS. 2, 4*a* and 5 of the patent) and serving to direct coherent streamlets of tobacco particles into a tobacco channel.

As already mentioned above, that portion of the tobacco channel 12 which receives tobacco particles from the guide 9 of the material supplying device 1*a* is narrower than the channel portion receiving tobacco particles T from the guide 9 in the device 1*b*. This can be ascertained by comparing FIGS. 2 and 3. The channel 12 comprises two sidewalls 23, 24 which extend upwardly and beyond the upper side of the upper reach of the conveyor 2. Such upper reach can be said to actually constitute the bottom wall of the channel 12.

The guide 9 in the material supplying device 1*a* has an edge face or end face 11, and the streams of compressed air issuing from the nozzle of the device 1*a* serve to propel the respective particles beyond the edge face 11 and toward the central portion of the channel 12 therebelow. This renders it possible to form on the upper reach of the conveyor 2 an elongated stream KS which is converted into the core K by removing the excess of particles of the first type. The means for removing such excess (above the line $T_1$ in FIG. 2) includes a conventional trimming or equalizing device 28 which is adjacent to the upper reach of the conveyor 2 between the material supplying devices 1*a* and 1*b*. For example, the equalizing device 28 may be of the type disclosed in U.S. Pat. No. 3,030,966. Other types of trimming devices can be used with equal or similar advantage. The provision of guide 9 in the material supplying device 1*a* contributes to the building of a predictable stream KS and to the formation of a highly satisfactory core K because the configuration of the guide 9 and the location of its edge face 11 can be readily selected in such a way that the particles which are to form the stream KS are directed into the central zone of the narrower portion of the channel 12 below the device 1*a*.

The guide 9 in the material supplying device 1*b* comprises three mutually staggered sections 9', 9'' and 9''' (FIGS. 1 and 5) respectively having discrete edge faces or end faces 11', 11'' and 11, 11', 11''. The purpose of the edge face 11' is to direct or aim particles T of tobacco into the right-hand corner portion of the channel 12 (see FIG. 5) and to form the marginal portion M1 of the first layer TL1 at one side of the core K. The edge face 11'' directs or aims tobacco particles T toward the other corner portion of the channel 12 to form the marginal portion M2 of the layer TL1, and the purpose of the third edge face 11', 11'', 11 is to spread tobacco particles T across the full width of the channel 12 below the material supplying device 1*b* so that the particles form the remaining portion of the layer TL1 above the core K as well as above the marginal portions M1 and M2. This completes the making of the major part of the filler TS, namely the part which is being built or formed on the upper reach of the air-permeable conveyor 2. The edge faces 11' and 11'' ensure that the relatively narrow clearances between the sides of the core K and the inner sides of the sidewalls 23, 24 are invariably filled with tobacco particles T to form predictable marginal portions M1 and M2. The edge face 11', 11'', 11 of the section 9''' of the second guide 9 in the material supplying device 1*b* ensures uniform showering of tobacco particles T across the full width of the channel 12 so that such particles form the upper part of the layer TL1, namely the part at a level above the upper side of the core K, as viewed in FIG. 3. The guide 9 of the material supplying device 1*b* imparts to the particles T which move along the sections 9', 9'' and 9''' a component of movement in the direction of arrow 21 (note the arrows 22*b* in FIGS. 1 and 3).

The device 1*b* supplies particles T of second material in excess of that which is required in a fully grown tobacco layer TL1. Therefore, the apparatus of FIG. 1 further comprises an adjustable trimming or equalizing device 29 which is located downstream of the guide 9 in the material supplying device 1*b* and serves to remove the excess (above the line $T_2$ in FIG. 3).

The pulley 26 for the conveyor 2 is located at a level below one pulley 31 for a second air-permeable endless belt conveyor 32 which is further trained over an additional pulley 33 (one of the pulleys 31, 33 is driven to advance the lower reach of the conveyor 32 in the direction which is indicated by arrow 39) and serves to accept the equalizing and partly confined core K as well as the equalized tobacco layer TL1 from the upper reach of the conveyor 2. To this end, the lower reach of the conveyor 32 constitutes the bottom wall of a second tobacco channel 36 (see FIG. 4) which has sidewalls 37, 38 extending downwardly beyond the underside of the lower reach of the conveyor 32. The upper side of this lower reach is adjacent to the air-permeable bottom wall (not specifically shown) of a suction chamber 34 which attracts successive increments of the equalized core K and equalized layer TL1 to the underside of the lower reach of the conveyor 32 at the transfer station between the pulleys 26 and 31, i.e., in the region where the suction chamber 14 ends and the suction chamber 34 begins. The device 1*c* showers (propels) particles T of the second type upwardly toward the underside of the lower reach of the conveyor 32. The construction of this device is preferably identical with or analogous to that which is disclosed in commonly owned U.S. Pat. No. 4,175,570. The device 1*c* propels the particles in the direction of arrows 22*c* (FIGS. 1 and 4) so that each particle a component of movement in the direction of the arrow 39 (namely in the direction of movement of the lower reach of the conveyor 32). The particles T are preferably delivered in excess of the requirements of the filler TF, and such excess (below the line $T_3$ in FIG. 4) is removed by an adjustable third equalizing device 41 which is adjacent to the underside of the lower reach of the conveyor 32 downstream of the material supplying device 1*c*. This completes the making of the continuous composite filler TS which comprises a centrally located trimmed core (K) and a continuous annular or tubular envelope including the trimmed layers TL1 and TL2. The filler TS is caused to advance onto a running web 43 of wrapping material (e.g., cigarette paper) which is supplied by a reel or another suitable source 43*a* and is caused to advance in a direction to the left, as viewed in FIG. 1, by the upper reach of an endless belt conveyor 42. The latter advances the web 43 and the filler TS through a conventional wrapping mechanism 44 wherein the web is draped around the filler TS and the latter is converted (condensed) into a cylindrical body. The overlapping marginal portions of the web 43 are bonded to each other to complete the conversion of the web 43 and filler TS into a continuous cigarette rod RS which passes through a density monitoring device 46. The latter can constitute a detector of the type known in the industry as NSR which includes a source of beta rays at one side of the path of the rod RS and a suitable transducer (e.g., an ionization chamber) at the other side of such path. The signals which the transducer of the monitoring device 46 transmits to a control circuit 45 are indicative of a characteristic (in this case density) of the filler in the rod RS. Such signals are compared with a reference signal denoting the optimum density of the wrapped filler and, if the monitored density deviates from the optimum density, the outputs of the control circuit 45 transmit signals to the adjustable equalizing devices 29 and 41 so as to raise or lower the material removing element or elements of each equalizing device in order to restore the optimum density. In other words, when the density of the filler which is confined in the wrapper of the rod RS is too low, the signals at the outputs of the control circuit 45 cause the equalizing devices 29 and 41 to reduce the rate of removal of excess tobacco from the layers TL1 and TL2 and vice versa. The manner in which the equalizing devices 29 and 41 can be adjusted in response to signals denoting one or more characteristics of a tobacco filler is well known in the tobacco processing industry. Reference may be had, for example, to commonly owned U.S. Pat. No. 4,280,516, 4,290,436 or 4,284,087.

It will be noted that the method and apparatus of the present invention depart radically from the teaching of the aforediscussed U.S. Pat. No. 3,987,804. Thus, whereas the patent proposes to form a first tobacco layer, to deposit thereon a stream which is narrower than the first layer and is to form the core, and to thereupon deposit a second tobacco layer on the core and on those marginal portions of the first layer which extend beyond the stream, the present method and apparatus provide that the core be formed in a first step, that such core be overlapped by a wider first tobacco layer, that the core and the first layer be transferred from a first onto a second conveyor, and that the second layer be formed on the second conveyor in such a way that it overlies the exposed surface of the core and the marginal portions of the first stream. The improved method and apparatus exhibit the advantage that the core can be much more readily centered between the marginal portions of the first tobacco layer, i.e., that the core is invariably located at the center of the composite filler. While it is also possible to build the stream which constitutes or is converted into the core of the filler on a separate conveyor, the apparatus of FIGS. 1 to 5 exhibits the important advantage that one and the same conveyor 2 can be used for the building (preferably showering) of the core K as well as for the building (preferably showering or analogous deposition) of the first tobacco layer TL1. The equalizing step by means of the device 28 or an analogous trimmer is advantageous and desirable but optional.

As a rule, the width of the tobacco channel in a cigarette rod making machine is between 8 and 10 mm. The diameter of the cigarette is less because the filler TS is condensed during passage through the wrapping mechanism 44. As can be seen in FIG. 3, the width of the core K can approximate or equal one-third of the width of the finished filler. The relatively narrow portion of the channel 12 at the level below the material supplying device 1*a* ensures that the particles of first material are showered onto the central portion of the upper reach of the conveyor 2 so that the core K will be equidistant from those portions of the sidewalls 23, 24 which flank the channel 12 in the region below the material supplying device 1*b*. The guide 9 of the device 1*b* and its sections 9', 9'' ensure that the particles of second material fill the two gaps between the core K and the sidewalls 23, 24 in the region where the guide 9 aims tobacco particles T into the channel 12 by propelling such particles beyond the edge faces 11' and 11'' to form the marginal portions M1 and M2 of the first layer TL1. Predictable formation of the marginal portions M1 and M2 is further enhanced due to the fact that these marginal portions are not formed simultaneously, i.e., that the sections 9' and 9'' of the guide 9 are staggered with reference to one another, as considered in the direction of the arrow 21. The configuration of the edge face 11, 11', 11'' of the section 9''' is such that this section spreads tobacco particles T across the full width of the channel 12 below the section 9'''. Trimming of the first tobacco layer TL1 by the device 29 or another suitable equalizing device is also optional but preferred and advantageous because trimming of the layer TL1, as well as trimming of the core K, increases the likelihood that the core K will be located at the center of the finished filler TS. Removal of excess tobacco in response to signals from the control circuit 45 (i.e., in response to signals denoting the density of the compacted filler in the cigarette rod RS) ensures that the weight of the ultimate products (e.g., plain cigarettes or filter cigarettes) will match or closely approximate an optimum value. The feature that the equalizing device 41 for the second tobacco layer TL2 is also adjustable in response to deviations of the density signal from an optimum value further enhances the likelihood of forming a filler TS wherein the core K is located at the center. The density is but one of several parameters of the filler TS in the rod RS which can be resorted to for adjustment of the equalizing devices 29 and 41 for the purpose of making a filler which has a centrally located core, i.e., which has at least one longitudinally extending symmetry plane that divides the core and the envelope into two mirror symmetrical halves.

Figure 6:
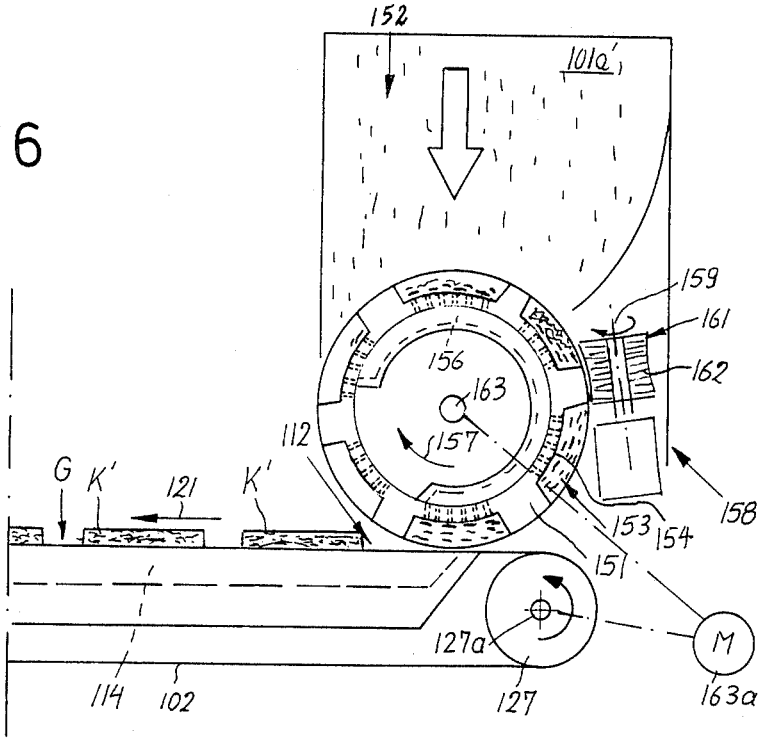
FIG. 6 is a fragmentary schematic partly elevational and partly longitudinal vertical sectional view of a second apparatus wherein the first material supplying device comprises a wheel-shaped conveyor serving to deliver a series of discrete sections of a core containing particles of first material.

FIG. 6 shows a modified material supplying device 101*a'* which can be used in lieu of the device 1*a* of FIGS. 1 and 2. This device comprises an upright duct 152 which receives and directs downwardly a preferably uniform shower of particles of first material such as is used to form the core of the filler. All such parts of the device 101*a'* and of the remaining portion of the apparatus of FIG. 6 which are identical with or analogous to the corresponding parts of the apparatus of FIGS. 1 to 5 are denoted by similar reference characters plus 100. The upper end of the duct 152 receives tobacco particles from a suitable source (not shown), such as the conveyor 3 in the device 1*a* and the nozzle 6 of FIG. 5. The guides 7 and 9 of the device 1*a* are replaced with a rotary wheel-shaped conveyor 151 which is disposed in the path of tobacco particles descending in the duct 152 and has a set of six equidistant circumferentially extending recesses or pockets 153 which are machined into its peripheral surface and serve to gather sections K' of a discontinuous stream constituting or being convertible into an interrupted core replacing the core K of FIG. 3. Successive pockets 153 are overfilled with particles of tobacco during travel from the nine toward the two o'clock position of FIG. 6 (the conveyor 151 is driven to rotate in the direction which is indicated by the arrow 157), and the excess is removed by an equalizing device 161 including a brush whose radially outwardly extending bristles 162 constitute excess removing elements of the equalizing device 161 and rotate about an axis 159 which is normal to the horizontal axis of the conveyor 161. The shaft 163 of the conveyor 151 is driven by a prime mover 163*a* in synchronism with the shaft 127*a* for the pulley 127 so that the peripheral speed of the conveyor 151 matches the speed of the upper reach of the belt conveyor 102. The conveyor 151 rotates about a stationary suction chamber 156 which is inwardly adjacent to air-permeable bottoms 154 of the pockets 153 and extends along an arc of more than 270° so as to attract the particles of tobacco in those pockets 153 which gather fresh sections K′ as well as to ensure that such sections remain in the respective pockets 153 during travel past the equalizing device 161 and toward the locus of transfer of successive sections K′ onto the upper reach of the conveyor 102. The shaft for the bristles 162 of the equalizing device 161 is driven by a constant-speed motor 158.

The axial length of the wheel-shaped conveyor 151 is slightly less than the width of the corresponding (preferably narrower) portion of the tobacco channel 112 therebelow. The mounting of the equalizing device 161 in such a way that the rotating bristles 162 sweep along the peripheral surface of and in the axial direction of the conveyor 151 (i.e., at right angles to the longitudinal directions of the pockets 153) ensures that each pocket 153 which advances beyond the device 161 contains a section K′ of predetermined size. The inclination of the axis 159 with reference to a vertical plane and to the axis of the shaft 163 can be readily selected in such a way that the bristles 162 furnish a highly satisfactory equalizing action, preferably in the axial direction of the conveyor 151. The removed excess can be returned into the upper end portion of the duct 152. The transfer of equalized sections K′ from the pockets 153 onto the upper reach of the conveyor 102 takes place under the action of the suction chamber 114 which is effective in the region where the arcuate suction chamber 156 ends.

The sections K′ on the conveyor 102 are thereupon overlapped by the first tobacco layer TL1 in a manner as described in connection with FIGS. 1, 3 and 5, and the layer TL1 is trimmed (if necessary) prior to transfer of the composite core including the sections K′ and of the first layer TL1 onto the lower reach of a second airpermeable conveyor corresponding to the conveyor 32 of FIG. 1. The freshly exposed surfaces of the core including the sections K′ and of the first layer TL1 are thereupon overlapped by a second tobacco layer TL2 which is trimmed, if necessary, prior to draping of the resulting filler into a web of cigarette paper or the like. The formation of the first layer TL1 and/or second layer TL2 around the composite core including the sections K′ is carried out in such a way that the particles of second material fill the gaps G between successive sections K′ on the upper reach of the conveyor 102 and/or on the lower reach of the second conveyor corresponding to the conveyor 32 of FIG. 1. This ensures the formation of a solid filler wherein each and every section K′ is completely surrounded by particles of second material. The prime mover 163*a* for the shafts 163 and 127*a* preferably also drives the customary cutoff (not shown but see 14 in U.S. Pat. No. 4,290,436) which subdivides the rod RS into plain cigarettes of desired length. The operation of the cutoff is synchronized with operation of the conveyor 151 in such a way that the knife or knives of the cutoff sever the rod RS (wherein the core of the filler consists of a series of discrete sections K′) invariably midway across the filled gaps G so that the end portions of the sections K′ are not visible in the respective rod-shaped smokers' articles. This may be desirable if the color of first particulate material is different from (e.g., lighter than) the color of the second particulate material which forms the tubular envelope for the core.

As mentioned above, the apparatus which utilizes the wheel-shaped conveyor 151 or an analogous means for forming sections K′ of a composite core is desirable and advantageous when the material of the core should be fully concealed within the material of the tubular envelope for the core. Such situation will normally arise when the color of the material of the core is such that it might detract from the appearance of the ultimate product and/or when the consistency of the material of the core is such that its particulate material would be likely to escape at one or both ends of the ultimate product if the core would extend all the way to the one and/or the other end face of a cigarette, cigarillo or an analogous rod-shaped tobacco-containing article. The feature that the material of the layer TL1 and/or TL2 fills the gaps G between successive sections K′ on the upper reach of the conveyor 102 ensures that the density of end portions of the finished articles is not too low in spite of the absence of first particulate material in such end portions.

FIGS. 7 to 11 illustrate a further apparatus wherein the endless belt conveyor 2 or 102 is replaced with a rotary wheel-shaped conveyor 202. The first material supplying device comprises a tubular material delivering element 201 which delivers a shower or stream of first particulate material from a suitable source 1A, and such stream forms at the periphery of the conveyor 202 a core K (see also FIG. 8). The conveyor 202 has an air-permeable peripheral wall 203 surrounding a stationary suction chamber 207*a*, 207*b* and a stationary valving element 206 which seals the left-hand portion of the wall 203 from the suction chamber. The conveyor 202 is driven in a counterclockwise direction, as viewed in FIG. 7, by a shaft 204. The width of the lower portion 207*a* of the suction chamber within the confines of the air-permeable wall 203 is less than the width of the portion 207*b*. The discharge end of the element 201 admits particles of first material against successive increments of the wall 203 in the region of the narrower portion 207*a* of the suction chamber, and the excess of such material is removed by an equalizing device 212 in the form of a paddle wheel which propels the removed excess into an evacuating (suction) pipe 213. The discharge end of the element 201 and the intake end of the pipe 213 are integral with or connected to the narrower portion 208*a* of a tobacco channel which has walls 209, 211 flanking the growing core as well as the equalized core K.

The width of the tobacco channel increases downstream of the portion 208*a*, as at 208*b* (see FIG. 9) so that its width suffices for the formation of a first tobacco layer TL1 whose particles T are delivered by a tubular element 214. The first layer TL1 surrounds three sides of the equalized core K and contains an excess of particles T; such excess is removed by an equalizing device 217 which directs the removed excess into an evacuating (suction) pipe 216. The latter can also serve (or can serve exclusively) for withdrawal of surplus air which is used to convey the particles T in the element 214.

Figures 7, 8, 9, 10, 11:
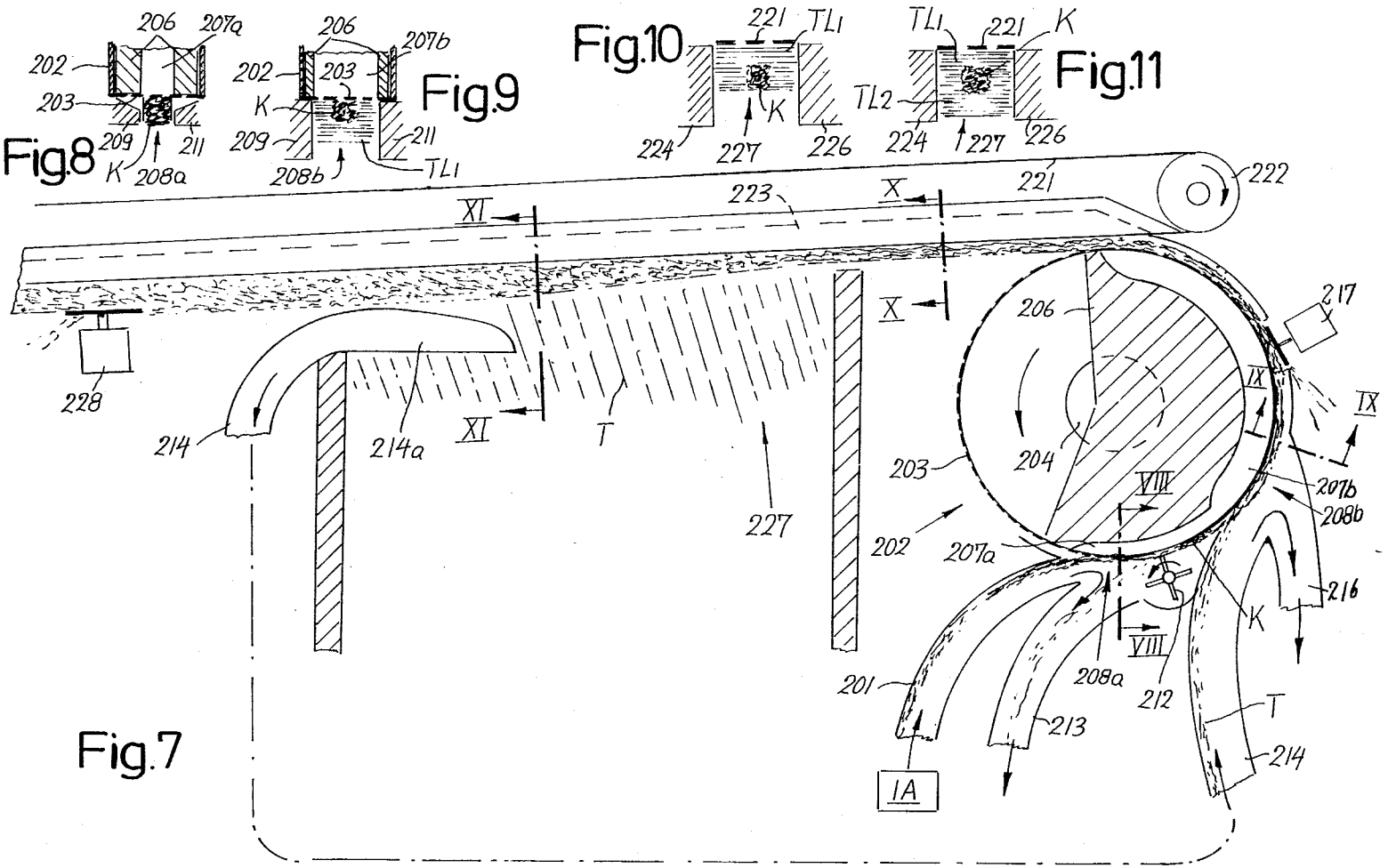
FIG. 7 is a schematic partly elevational and partly longitudinal vertical sectional view of a third apparatus wherein the first conveyor is a rotary wheel and the material of the second type is supplied by a single distributor.
FIG. 8 is an enlarged fragmentary transverse vertical sectional view as seen in the direction of arrows from the line VIII—VIII of FIG. 7.
FIG. 9 is an enlarged fragmentary transverse substantially horizontal sectional view as seen in the direction of arrows from the line IX—IX of FIG. 7.
FIG. 10 is an enlarged fragmentary transverse vertical sectional view as seen in the direction of arrows from the line X—X of FIG. 7.
FIG. 11 is an enlarged fragmentary transverse vertical sectional view as seen in the direction of arrows from the line XI—XI of FIG. 1.

The first layer TL1 and the core K are transferred from the peripheral wall 203 of the conveyor 202 onto the underside of the lower reach of an endless air-permeable belt conveyor 221 corresponding to the conveyor 32 of FIG. 1. The conveyor 221 is trained over two pulleys 222 (only one shown) one of which is driven so that the conveyor 221 moves at the speed of the peripheral wall 203. A suction chamber 223 above the lower reach of the conveyor 221 begins where the wider portion 207*b* of the suction chamber in the interior of the conveyor 202 ends so that the layer TL1 and the core K are transferred onto the conveyor 221 which advances successive increments of the core and first layer past the discharge end of a tobacco channel 227 receiving particles T from a material supplying device which corresponds to the device 1*c* of FIG. 1. The channel 227 has sidewalls 224, 226 (see FIGS. 10 and 11) which determine the width of the second layer TL2. The making of the layer TL2 is completed before the respective increment of the resulting filler reaches the left-hand end of the channel 227, as viewed in FIG. 7. The particles T which travel upwardly in the left-hand portion of the channel 227 are intercepted by the suitably configurated intake end 214*a* of the element 214 which delivers the particles to the conveyor 202 in the region of the wider portion 207*b* of the respective suction chamber. The cross-sectional configuration of the filler is shown in FIG. 11. If the layer TL2 contains a surplus of particles T, such surplus is removed by a further trimming or equalizing device 228 which is located downstream of the intake end 214*a* of the element 214, as seen in the direction of travel of the lower reach of the conveyor 221. The intake end 214*a* of the element 214 can resemble an elongated mouthpiece which draws the oncoming (rising) particles T into the element 214.

An important advantage of the tubular element 214 and its intake end 214*a* is that the material supplying device 1*b* of FIGS. 1 and 5 can be omitted because the material supplying device which admits particles T into the channel 227 also supplies particles T for the making of the first layer TL1 with or without excess tobacco.

An advantage of the rotary conveyor 202 is that it contributes significantly to a reduction of the overall length of the apparatus. While the apparatus of the present invention also employs (or can also employ) a tobacco channel which is narrower in the region of one material supplying device and wider in the region of the other material supplying devices, such configuration of the tobacco channel does not promote the development of the aforediscussed stoppers which are likely to develop if the apparatus is constructed in a manner as disclosed in U.S. Pat. No. 3,987,804. This is due to the fact that the width of the channel which is used in the apparatus of the present invention increases between the first and second material supplying devices whereas the apparatus of U.S. Pat. No. 3,987,804 comprises a tobacco channel which has a wider portion that is followed by a narrower portion or constriction so that the particles of tobacco are likely to pile up in the zone where the width of the tobacco channel decreases. Absence of stoppers in the channels of filler forming apparatus is especially important and desirable in modern high-speed cigarette rod making and analogous machines wherein even short-lasting interruptions of operation can result in huge losses of output.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing a rod-like tobacco filler wherein a core containing a first particulate material is surrounded by an annular envelope containing a different second particulate material, comprising the steps of building on an air-permeable first conveyor a stream of first material having a first width; pneumatically holding the stream on the first conveyor so that one side of the stream abuts against the conveyor; utilizing the conveyor to advance the stream lengthwise; depositing on the conveyor a first elongated layer containing said second material and having a greater second width so that a central portion thereof overlies the stream and two marginal portions thereof extend laterally beyond the stream; transferring the first layer and the stream onto a second conveyor so that the one side of the stream becomes exposed; utilizing the second conveyor to advance the stream and the first layer lengthwise; and depositing on the one side of the stream and on the marginal portions of the first layer a second layer containing said second material and forming with said first layer said annular envelope which surrounds the stream.

2. The method of claim 1, wherein said building step includes showering particles of first material onto the first conveyor.

3. The method of claim 1, wherein said building step includes depositing on the first conveyor particulate material in excess of that required in the stream and further comprising the step of removing the excess of first material prior to deposition of said first layer.

4. The method of claim 1, wherein said building step comprises depositing on the first conveyor a file of discrete stream sections of finite length.

5. The method of claim 1, wherein said step of depositing said first layer includes depositing particles of second material first at one side of the stream to form one of the marginal portions, thereupon at the other side of the stream to form the other marginal portion, and thereafter over the stream to form the central portion of the first layer.

6. The method of claim 1, wherein the step of depositing said first layer includes delivering onto the first conveyor second material in excess of that which is required in the first layer and further comprising the step of removing the excess prior to said transferring step.

7. The method of claim 1, wherein the step of depositing said second layer includes delivering onto the second conveyor second material in excess of that which is required in the second layer and further comprising the step of removing the excess of second material from the second conveyor.

8. The method of claim 7, further comprising the steps of draping the filler including said stream and said layers into a web of wrapping material, monitoring the density of the draped filler and regulating the excess removing step as a function of changes in monitored density of the filler.

9. The method of claim 1, wherein the steps of depositing said layers include respectively delivering onto the first and second conveyors particles of second material in excess of that required in the corresponding layers and further comprising the steps of removing the excess from the first layer on the first conveyor, removing the excess from the second layer, draping the resulting filler into a web of wrapping material, monitoring at least one characteristic of the wrapped filler, and regulating the removal of excess from the first and second layers in response to deviations of the monitored characteristic from a preselected value.

10. The method of claim 9, wherein said characteristic is the density of the filler.

11. Apparatus for producing a rod-like tobacco filler wherein a core containing a first particulate material is surrounded by an annular envelope containing a different second particulate material, comprising an air-permeable first conveyor having a first and a second side and a predetermined width; means for establishing between said sides a pressure differential so that the pressure at one of said sides exceeds the pressure at the other of said sides; a first material supplying device arranged to deposit on the one side and substantially centrally of said conveyor an elongated stream containing particles of first material, having a second width which is less than said predetermined width so that two marginal portions of said one side of said conveyor remain exposed, and a surface which directly contacts said conveyor; a second material supplying device arranged to deposit on the stream and on the marginal portions of said one side a first layer containing said second material and having marginal portions directly overlying said conveyor; a second conveyor arranged to receive the stream and the first layer from said first conveyor so that the first layer directly overlies the second conveyor and said surface of the stream becomes exposed; and a third material supplying device arranged to deposit on said surface of the stream and on said marginal portions of the first layer a second layer containing particles of second material so that the stream is fully confined between the first and second layers.

12. The apparatus of claim 11, further comprising a pair of sidewalls flanking said first conveyor and extending beyond said one side thereof, said pressure differential establishing means comprising a suction chamber adjacent to said other side of said first conveyor.

13. The apparatus of claim 12, wherein said second conveyor is permeable to air and has first and second sides, and further comprising two additional sidewalls extending beyond the first side of said second conveyor and a second suction chamber adjacent to the second side of said second conveyor so that the first layer is attracted to the first side of said second conveyor.

14. The apparatus of claim 13, wherein the sidewalls of said pair and said first conveyor define a first elongated channel having a substantially rectangular cross-sectional outline, said additional end walls and said second conveyor defining a second elongated channel having a substantially rectangular cross-sectional outline, said first and second material supplying devices being arranged to admit particulate material into said first channel and said third material supplying device being arranged to supply particulate material into said second channel.

15. The apparatus of claim 11, wherein said first conveyor is an endless belt conveyor.

16. The apparatus of claim 11, wherein said first conveyor is a rotary wheel-shaped conveyor.

17. The apparatus of claim 11, wherein said second conveyor is an endless belt conveyor.

18. The apparatus of claim 11, further comprising a pair of sidewalls extending beyond said one side of said first conveyor and defining therewith a channel including a narrower first portion arranged to receive particulate material from said first material supplying device and a wider second portion arranged to receive particulate material from said second material supplying device.

19. The apparatus of claim 18, wherein said first material supplying device includes means for showering particulate material into the first portion of said channel.

20. The apparatus of claim 19, wherein said first material supplying device further comprises a source of first particulate material and said showering means comprises a guide arranged to direct particles of first material from said source into the central region of said first portion of said channel and means for propelling particles of first material along said guide.

21. The apparatus of claim 11, wherein said first material supplying device is arranged to supply first particulate material in excess of that which is required in the stream and further comprising an equalizing device adjacent to said first conveyor ahead of said second material supplying device, as considered in the direction of advancement of the stream with said first conveyor, and arranged to remove the excess from the stream on said first conveyor.

22. The apparatus of claim 11, wherein said first material supplying device includes means for delivering to the one side of said first conveyor a file of discrete elongated sections of said stream so that successive sections of said file are separated from one another.

23. The apparatus of claim 22, wherein said delivering means comprises a rotary conveyor having a peripheral surface provided with an annulus of elongated pockets each arranged to accumulate a discrete section of the stream and to deliver such section to the one side of the first conveyor.

24. The apparatus of claim 23, wherein said rotary conveyor has a foraminous bottom wall inwardly adjacent to said pockets and a suction chamber adjacent to said bottom wall opposite said pockets to draw particulate material into the pockets and to attract the thus drawn particulate material during delivery to the one side of the first conveyor.

25. The apparatus of claim 24, further comprising means for driving said rotary conveyor in synchronism with said first conveyor.

26. The apparatus of claim 24, wherein said first material supplying device further comprises means for showering particles of first material into the pockets of said rotary conveyor.

27. The apparatus of claim 26, wherein said showering means is arranged to shower particles of first material into said pockets in excess of that which is required in the respective sections of the stream, and further comprising equalizing means adjacent to said rotary conveyor and including means for removing the excess of particulate material from successive pockets.

28. The apparatus of claim 27, wherein said excess removing means comprises material entraining elements arranged to rotate about a predetermined axis which is at least substantially normal to the axis of rotation of said rotary conveyor.

29. The apparatus of claim 11, further comprising a pair of sidewalls extending beyond the one side of said first conveyor and defining therewith an elongated channel arranged to receive particulate material from said second material supplying device, said second material supplying device including guide means arranged to direct particles of second material against said marginal portions of said one side of said first conveyor, a source of second material and means for propelling particles of second material from said source, along said guide means, and against the marginal portions of said one side of said first conveyor.

30. The apparatus of claim 29, wherein said guide means includes a first section arranged to direct particles of second material first against one marginal portion of said one side and a second section arranged to thereafter direct particles of second material against the other marginal portion of said one side of said first conveyor.

31. The apparatus of claim 29, wherein said guide means comprises a section arranged to direct particles of second material across the full width of said first conveyor.

32. The apparatus of claim 11, wherein said second material supplying device is arranged to deliver particulate material in excess of that which is required in the first layer and further comprising an equalizing device arranged to remove the excess from the first layer prior to transfer of such first layer onto said second conveyor.

33. The apparatus of claim 11, wherein said third material supplying device is arranged to deliver particulate material in excess of that which is required in the second layer and further comprising an equalizing device having means for removing the excess from the second layer.

34. The apparatus of claim 33, wherein said equalizing means is adjustable and further comprising a source of wrapping material, means for draping the filler including said stream and said layers into said wrapping material, means for monitoring the density of the wrapped filler, and means for adjusting said equalizing device when the monitored density of the wrapped filler deviates from a predetermined value.

35. The apparatus of claim 11, wherein said second and third material supplying devices are arranged to respectively deliver particulate material in excess of that which is required in the first and second layers, and further comprising a first adjustable equalizing device having means for removing the excess from said first layer, a second equalizing device having means for removing the excess from said second layer, a source of wrapping material, means for draping the filler including the equalized layers and the stream into said wrapping material, means for monitoring a characteristic of the draped filler, and means for adjusting said equalizing means when the monitored characteristic of the draped filler deviates from a predetermined value.

36. The apparatus of claim 35, wherein said monitoring means includes means for monitoring the density of the draped filler.

* * * * *